United States Patent [19]

Ohtake

[11] Patent Number: 4,768,357

[45] Date of Patent: Sep. 6, 1988

[54] METHOD FOR KNITTING A FLAT KNITTED FABRIC, A FLAT KNITTING MACHINE AND A NOVEL FLAT KNITTED FABRIC KNITTED BY SAID FLAT KNITTING MACHINE

[75] Inventor: Nobumitsu Ohtake, Tokyo, Japan

[73] Assignee: Asahi Kasei Kogyo Kabushiki Kaisha, Osaka, Japan

[21] Appl. No.: 12,543

[22] Filed: Feb. 9, 1987

[30] Foreign Application Priority Data

Feb. 13, 1986 [JP] Japan ..... 61-29519

[51] Int. Cl.[4] ..... D04B 7/00

[52] U.S. Cl. ..... 66/75.2; 66/126 R; 66/128

[58] Field of Search ..... 66/75.2, 126, 125, 127, 66/128, 8

[56] References Cited

U.S. PATENT DOCUMENTS 4,697,438 10/1987 Muller et al. ..... 66/75.2
4,724,686 2/1988 Koike ..... 66/75.2

FOREIGN PATENT DOCUMENTS 2100891 7/1972 Fed. Rep. of Germany ..... 66/75.2
2544321 1/1974 Fed. Rep. of Germany .
1113582 3/1956 France .
227781 10/1943 Switzerland .
544829 1/1974 Switzerland .
546847 3/1974 Switzerland ..... 66/75.2
2147616A 5/1985 United Kingdom .

*Primary Examiner*—Ronald Feldbaum
*Attorney, Agent, or Firm*—Finnegan, Henderson, Farabow, Garrett and Dunner

[57] ABSTRACT

A method for knitting a flat knitted fabric, wherein all knitting needles of the flat knitting machine are individually connected to an actuator, and each actuator of the corresponding knitting needle is activated in accordance with the predetermined knitting plan, and a flat knitting machine for implementing the above-mentioned knitting method. Preferably a linear direct current motor is used as the actuator. The flat knitting machine in accordance with the present invention can be operated at a higher speed than known conventional knitting machines and can provide a novel flat knitted fabric which cannot be knitted by the conventional flat knitting machine, by individually changing a retracting length of a needle.

15 Claims, 12 Drawing Sheets

METHOD FOR KNITTING A FLAT KNITTED FABRIC, A FLAT KNITTING MACHINE AND A NOVEL FLAT KNITTED FABRIC KNITTED BY SAID FLAT KNITTING MACHINE

BACKGROUND OF THE INVENTION (1) Field of the Invention

The present invention relates to a new method for knitting a flat knitted fabric, a flat knitting machine for implementing the above-mentioned knitting method, and a novel flat knitted fabric capable of being knitted by using the above-mentioned flat knitting machine. Especially, the present invention relates to the knitting method in which the predetermined knitting movement of the knitting needle is caused by operating each actuator connected to each knitting needle in accordance with a predetermined knitting plan, the flat knitting machine for implementing the above-mentioned knitting method, and the novel flat knitted fabric capable of being knitted by using the above-mentioned flat knitting machine.

(2) Description of the Related Art

A known flat knitting fabric hereinbefore is knitted by moving a plurality of knitting needles arranged slidably in a needle bed fixed on a frame of a flat knitting machine into a knitting position, a tuck position or a welt position by a plurality of cams arranged in a carriage moving reciprocally along the needle bed. Accordingly, to change a knitting design, it is necessary to correspondingly adjust an arrangement of the plurality of cams to the design of the knitted fabric to be knitted. In a case when a jacquard mechanism is used to knit a knitted fabric having a complicated pattern, the plurality of knitting needles are operated by the jacquard mechanism and the change of the knitting design is performed by adjustment of the jacquard mechanism.

There are several restrictions in the knitting of the flat knitted fabric performed by the known conventional flat knitting machine having the above-mentioned constitution, and these restrictions will be explained hereinafter. The knitted fabric knitted by the known flat knitting machine has a plurality of knitting loops of equal size in a course direction. An advantage is obtained in that the knitted fabric having a good aesthetic appearance is provided because the size of the loops is uniform. However a hand knitted fabric is highly evaluated by consumers as a high grade knitted product among knitted fabrics, especially among knitted fabrics for outer wear. The biggest advantage of the hand knitted fabric is the irregularity in the size of the knitting loops, making it possible to obtain an individual appearance and feeling. The appearance and the feeling of the hand knitted fabric cannot be obtained by using the known flat knitting machine having the above-mentioned constitution. Therefore, although the demand for the hand-knitted products is large, it is impossible to satisfy this demand due to limitations in production capacity and high costs.

Also, there are the following problems in the mechanism of the flat knitting machine.

(1) The weight of the carriage is heavy, and thus, when the moving direction of the carriage is reversed at a point where the carriage arrives at an end of the reciprocal movement of the carriage, the inertia force applied to the carriage becomes large. Accordingly, when the moving speed of the carriage is increased to obtain a high productivity, the carriage itself and a mechanism for driving the carriage, such as a chain or the like are apt to be damaged. Accordingly, an increase of the speed of the carriage in the known flat knitting machine is restricted.

(2) It is well known to increase the number of thread feeding units to increase the productivity of the flat knitting machine. However, when the number of the thread feeding units is increased, it is necessary to arrange a number of cams corresponding to the number of thread feeding units, therefore, the weight of the carriage is increased. Further, since the length in the sliding direction of the carriage is increased, the distance of the reciprocal movement of the carriage is increased, so that ratio of a time in which both ends of the carriage run on the needle bed and do not contribute to the knitting of the knitted fabric during the reciprocal movement of the carriage, to the total running time of the carriage, is increased. This means that the time wasted during the knitting is increased. Therefore, there is the above-mentioned restriction to the increase of the number of thread feeding units.

(3) Since the sliding movement of the knitting needle is performed by the cams, it is necessary to make complicated adjustments when changing the design, and an adjustment of the number of coarses and/or wales is performed. Further, the carriage having cams includes many parts, so that maintenance of these parts is time-consuming.

(4) When the speed of the flat knitting machine is increased, the impact of a butt of the knitting needle on the cam, abrasion of the knitting needle when the needle slides against the needle bed, abrasion of the butt of the knitting needle by sliding the butt against the cam, and heat caused by the above-mentioned operations are increased. Therefore, there is an upper limit to the knitting speed that can be used, and there is a problem in that the life of the knitting needle and parts of the flat knitting machine are shortened, even when the flat knitting machine is driven at a usual speed.

As described hereinbefore, although the flat knitting machine manufactured on the basis of the known knitting method is widely used, for improving the productivity of the flat knitting machine and obtaining various knitted fabrics, the known flat knitting machine has several problems to be solved.

Several flat knitting machines having an improved mechanism are proposed. For example, a flat knitting machine having a carriage of which cams are replaced with linear motors was disclosed in Japanese Unexamined Patent Publication (Kokai) No. 54-6979. However, the weight of this carriage having the linear motors is heavy and the linear motors for operating the knitting needle are only installed on the each carriage, so that the knitting needles are only operated at a place where the carriage exist. Therefore it is impossible to improve the productivity of the conventional knitting machine.

A flat knitting machine having a plurality of disks for slidably moving a corresponding knitting needle was disclosed in U.S. Pat. No. 4,127,012. However, this flat knitting machine has a disadvantage that the disk must be replaced with another disk when a knitting design of the knitted fabric is changed and it is impossible to knit a novel flat knitted fabric which cannot be knitted by the known conventional knitting machine.

SUMMARY OF THE INVENTION

An object of the present invention is to overcome the above-mentioned problems of the known knitting method and to provide a knitting method capable of knitting a conventional knitted fabric at a higher speed than that of the known knitting method and, if necessary, knitting a novel knitted fabric which cannot be knitted by the known knitting method.

Another object of the present invention is to provide a flat knitting machine capable of implementing the above-mentioned knitting method.

A further object of the present invention is to provide an novel knitted fabric capable of being knitted by using the above-mentioned flat knitting machine.

The method for knitting the flat knitted fabric in accordance with the present invention uses a flat knitting machine comprised of a plurality of knitting needles each having an actuator and arranged in parallel in a plane, a knitting needle guiding member slidably supporting the plurality of knitting needles, extended in either direction along the plane and defining each distance between adjacent knitting needles, and a running device having at least one thread feeding unit and reciprocally moving in either direction along the knitting needle guiding member, in place of a constitution of the known flat knitting machine. The knitting method in accordance with the present invention is characterized in that a position of the thread feeding unit of the running device is detected and a signal in accordance with a predetermined knitting plan is input to the actuator of each knitting needle corresponding to the thread feeding unit of which the position was detected and thereby a sliding movement in accordance with the predetermined knitting plan is applied to the knitting needle to knit the flat knitted fabrics.

Said predetermined knitting plan includes sliding lengths of the sliding movement of the knitting needle and orders of operation thereof. When the sliding lengths of the sliding movement of each knitting needle are the same, a retracting length of each knitting needle become the same, so that a knitting fabrics having a plurality of loops of the same length is obtained. If a predetermined knitting plan wherein different sliding lengths are provided for at least some knitting needle is applied, it is possible for each knitting needle to perform a knitting movement at a different retracting length, so that a knitted fabric similar to a hand knitted fabric can be obtained.

The flat knitting machine in accordance with the present invention includes at least one knitting mechanism comprised of a plurality of knitting needles arranged in parallel in a plane and a knitting needle guiding member slidably supporting the plurality of knitting needles, extended in either direction along the plane and defining each distance between adjacent knitting needles to form a knitting loop, at least one running device capable of reciprocally moving in either direction along the knitting needle guiding member, at least one thread feeding unit being provided in the running device, an actuator providing a corresponding slidable movement to each knitting needle, and connected to each knitting needle, of the plurality of knitting needles, and a controlling apparatus having a memory storing a predetermined knitting plan and controlling the operation of the actuator to synchronize with the reciprocal movement of the thread feeding unit in accordance with the predetermined knitting plan.

Various type of actuators can be used as the above-mentioned actuator, and further, the control of the operation of the actuator can be varied in accordance with the type of actuator used.

For example, when a thin and compact linear motor is used as the actuator, the sliding position of the knitting needle can be controlled by connecting the knitting needle to a movable element of the linear motor. Namely since the sliding movement of the knitting needle and the movement of the actuator alike are linear, connection between the knitting needle and the actuator can be obtained by connecting the knitting needle to the movable element of the linear motor. Therefore, a construction of the actuator itself and the connection between the actuator and the needle is simple and compact. Consequently, if the thin and compact type linear motor is used as the actuator of the flat knitting machine in accordance with the present invention, it is possible to arrange many actuators in a narrow space. A linear pulse motor, a linear direct current motor, a linear induction motor or the like can be used as the actuator of the flat knitting machine in accordance with the present invention. Especially, since the linear direct current motor has the most simple construction and can provide a high thrust force, the linear direct current motor is most suitable for a case wherein thin as well as compact size and high speed actuator are required.

Although a rolling bearing such as a roller bearing or ball bearing usually can be used as the bearing supporting the movable element of the linear motor, preferably a pneumatic bearing or a magnetic bearing is used, to decrease the sliding resistance of the bearing. When the pneumatic bearing is used, compressed air must be supplied. However when a repulsion type magnetic bearing using a permanent magnetic is used, a construction of this bearing becomes simple and the sliding resistance of the bearing is small. Further a thin and compact rotary motor and a device converting rotational movement of the motor to a linear movement can be used as the actuator. In this case, since, for example, a combination of a pulley and a wire, or a screw mechanism or the like must be used for converting the rotational movement of the actuator to a linear movement, the construction of this actuator is complicated. However, the rotary motor and a controller thereof are more readily available than the linear motor, and thus is more convenient for production control.

Further, when a thin fluid cylinder and a selector valve for changing a fluid pressure of the fluid supplied to the cylinder are used as the actuator, it is possible to perform the knitting movement of the knitting needle by a change in the fluid pressure.

Further the knitting movement of the knitting needle may be performed by using an electromagnetic actuator, with a suitable ON-OFF control.

The running of the running device may be performed by using a mechanical driving means similar to a mechanism used in driving of the carriage of the known flat knitting machine, or another driving mechanism such as the linear motor or the like.

Various apparatus may be used as the controlling apparatus. For example, it is possible to wholly control the device by a computer system or to control the device by using several computers provided for suitable groups, in cooperation with each other. The controlling apparatus may be comprised of first controllers for controlling the corresponding knitting needle in accordance with the predetermined knitting plan stored in the memory, at least one second controller for controlling the reciprocal movement of the thread feeding unit in accordance with the predetermined knitting plan, and a third controller for controlling a timing of the operation corresponding to the operation of the second controller in the first controller in accordance with the predetermined knitting plan.

The memory storing operation of each controller in accordance with the predetermined knitting plan may be arranged for the each controller. Accordingly, it is unnecessary to provide a synchronizing means for synchronizing the operation between a knitting needle and the other knitting needles and/or a synchronizing means for synchronizing the operation between a thread feeding unit and the other thread feeding units. Further it is possible to decrease the frequency of control data communication between each controller by providing a memory storing the operation of each controller in accordance with the predetermined knitting plan in each controller, so that a high speed control can be realized.

The flat knitting machine of the present invention can be used to knit various knitted fabrics which can be knitted by the known conventional flat knitting machine. Moreover, since the actuator operated in accordance with the predetermined knitting plan is provided on each knitting needle in the flat knitting machine of the present invention, it is possible to knit a novel knitted fabric which cannot be knitted by the known conventional knitting machine.

In accordance with the present invention, a flat knitted fabric is provided with at least one portion of a plurality of knitting loop having an irregular length continuous in the direction of course. A knitting loop having an irregular length is formed by variable control of the length of the each knitting loop by the flat knitting machine of the present invention. The flat knitted fabric constituted by the plurality of knitting loops having an irregular length has a hand knitted appearance and feeling.

Further, a knitted fabric having a specific pattern can be knitted at a high speed by using the flat knitting machine of the present invention. It is, of course, well known that to apply a pattern to outerwear such as a sweater increases the value of the product as merchandize. As methods for applying the pattern, there are a jacquard knitting method in which two or more threads are selectively knitted and a method for forming a pattern by combining a knit loop, a tuck loop, a welt loop, a front loop, a back loop or the like. Since the former method requires two or more knitting movements for one loop, the productivity thereof is low. Further, there is a problem in that unnecessary threads which are not part of the pattern are arranged on a back of the knitted fabric, and thus the thickness of the knitting fabric is increased. In the latter method, the productivity is also low and loop transferring work is complicated. Further in the pattern formed by using the above-mentioned conventional knitting method, loops, which are apparently different from loops constituting a ground fabric, are mixed in the ground loops. Therefore it is impossible to knit a fine pattern, such as an ombre pattern.

The course in which loops having substantially the same length and loops having substantially different lengths are arranged in mixed state can be arranged in the knitted fabric so that a pattern in the flat knitted fabric is formed by a substantially continued arrangement of the loops having different lengths in the flat knitted fabric by using the flat knitting machine of the present invention, and thus it is possible to apply an optional pattern on the knitting fabric.

Since a heavy weight carriage as used in the known conventional flat knitting machine is not used in the flat knitting machine of the present invention, and the running device having the plurality of thread feeding units and which are much lighter than the conventional carriage is reciprocally moved in both directions along the knitting needle guiding member, the thread can be fed at a speed several times higher than that of the carriage. Further since a construction of the running device is simple and the thread feeding units can be arranged in a compact arrangement, even if many thread feeding units are used, it is possible to make the length of the running device short, and thus to shorten the wasted running time of the running device at both ends of a running course of the running device, where the knitting operation of the knitted fabric is not performed. Since the above-mentioned factors provide multiple effects, it is possible to increase the productivity by powers of ten, compared with the conventional knitting method, by using the knitting method of the present invention.

Further since the knitting needles do not strike against any portions of the machine, it is possible to drastically decrease the resistance of the sliding portions, lengthen the life of the knitting needles on the like, and realize a high speed operation of the flat knitting machine. Also, since the knitting needles are individually controlled by the actuators in the flat knitting machine, a complicated knitting pattern, which can not be realized by the known conventional knitting machine, can be obtained by using a microcomputer or the like. Further, even if the same knitting pattern as that of the knitted fabric knitted by the known conventional flat knitting machine is knitted by the flat knitting machine of the present invention, it is possible to produce a hand-knitted type fabric by the flat knitting machine of the present invention. Further it is possible to produce a knitted fabric having a pattern at the same knitting speed as that used when knitting a plain knitted fabric at a high speed, by using the flat knitting machine of the present invention. It is further possible to easily change the knitting design of the knitted fabric by changing the operation of the controlling apparatus.

The present invention will now be described with reference to the drawings illustrating embodiments of the flat knitting machine and the flat knitted fabric according to the invention.

DESCRIPTION OF THE PREFERRED EMBODIMENTS

Figure 1:
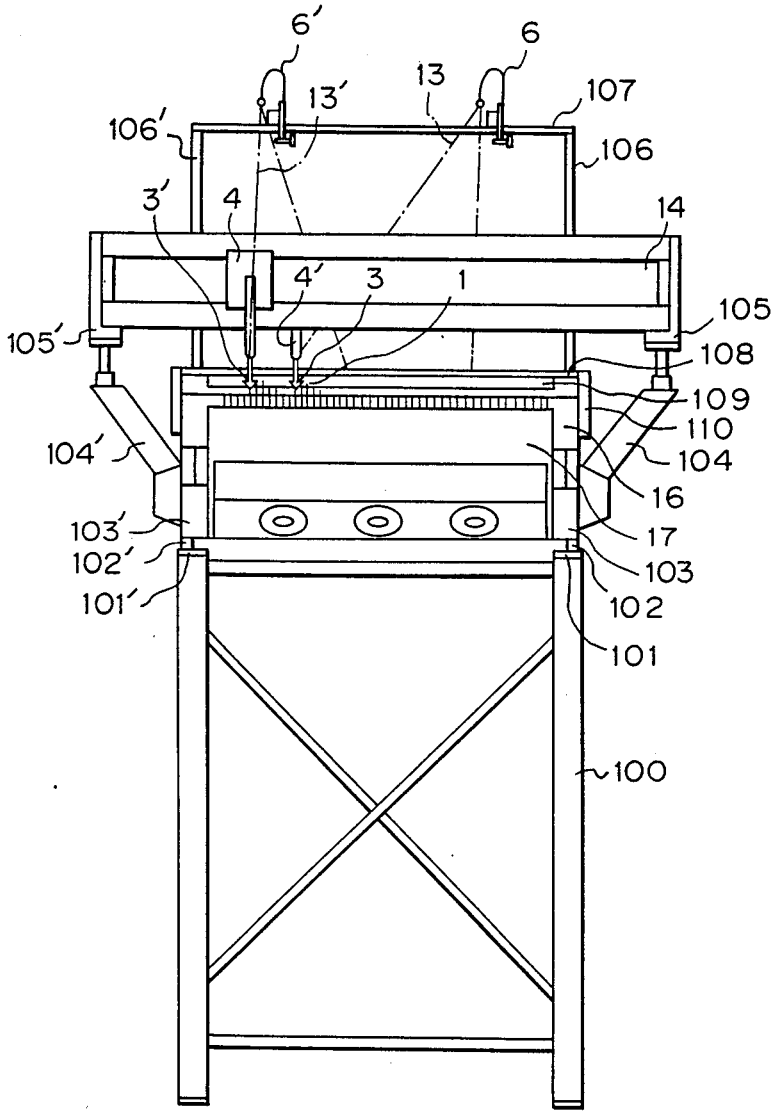
FIG. 1 is a front view illustrating an embodiment of a flat knitting machine in accordance with the present invention.
Figure 2:
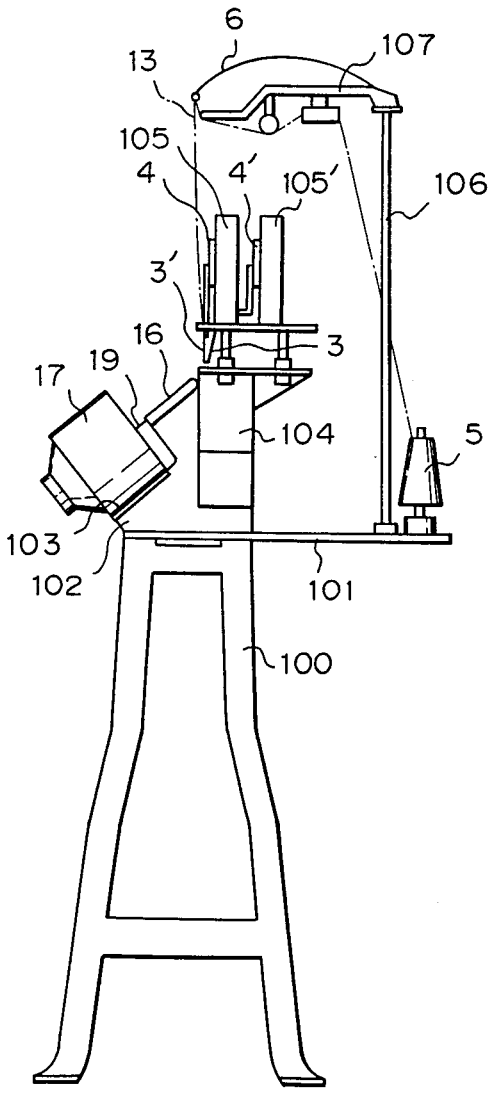
FIG. 2 is a side view of the flat knitting machine illustrated in FIG. 1.

An embodiment of the flat knitting machine of the present invention is shown in FIGS. 1 and 2. As shown in FIGS. 1 and 2, a main portion of the flat knitting machine is comprised of a plurality of knitting needles 1 arranged in parallel in a plane, a knitting needle guiding member 16 slidably supporting the plurality of knitting needles 1 and extended in either direction along the same plane, a running device 4 having at least one thread feeding unit 3 and reciprocally moving in either direction along the knitting needle guiding member 16, actuators 17 connected individually to the plurality of knitting needles 1, respectively, and applying a sliding movement to each knitting needle, and a controlling apparatus (not shown in FIGS. 1 and 2) for controlling the actuators 17 to operate synchronously with the reciprocal movement of the thread feeding units 3.

The flat knitting machine has a machine frame 100 comprised of two legs and side frames 102 and 102' mounted through base members 101 and 101' on the machine frame 100. Actuators 17 are mounted through supporting plates 103 and 103' on the side frames 102 and 102' and the sliding needle guide member 16 is also mounted on the side frames 102 and 102'. The running device 4 is supported on a supporting rail 14 and the supporting rail 14 is attached through supporting rail holding members 105 and 105' and supporting brackets 104 and 104' to the side frames 102 and 102'. A thread package 5 is mounted at the rear of the base member 101. Pillars 106 and 106' are also arranged on the base member 101, and a guiding member supporting member 107 holding a guiding roller (shown only in FIG. 2) and a spring 6 is attached to the pillars 106 and 106'. A brush 109 is arranged through a supporting bar 108 behind the knitting needles 1.

When knitting with the flat knitting machine as shown in FIGS. 1 and 2, a thread 13 is fed from the thread package 5, through the guiding roller and the spring 6 for applying tension to the thread 13, to the thread feeding unit 3, and the running device 4 having the thread feeding unit 3 is reciprocally moved in either direction along the guiding member 16. In the flat knitting machine as shown in FIGS. 1 and 2, the plurality of knitting needles 1 arranged in the guiding member 16 are connected through a jack 19 to the actuators 17, respectively. As described in detail hereinafter, the plurality of knitting needles 1 are slidably moved in accordance with the predetermined knitting plan to knit a desired knitted fabric by activating each actuator 17 through a controlling apparatus.

Two thread-feeding type flat knitting machines, each having a running device 4 and 4', are arranged on the two supporting rails 14 and 14' (FIG. 2 shows the supporting rail holding member 105 and 105'), respectively, and one thread feeding unit 3 is arranged on each running device 4 and 4' is shown in FIGS. 1 and 2. Note, it is possible to increase the number of running devices 4 and 4' by increasing the number of supporting rails 14 and 14' and/or the number of thread feeding units 3 on the running devices 4 and 4'. For example, ten thread feeding type flat knitting machines can be used by a corresponding increase in the number of supporting rails 14 and 14', or by arranging two running device on five supporting rails, respectively. Although FIGS. 1 and 2 show a flat knitting machine having a single bed, a flat knitting machine having a V-shaped double bed can be obtained by arranging a knitting mechanism including the guiding member 16, the knitting needles 1 and the actuators 17 symmetrically on both sides of the thread feeding line.

Figure 4:
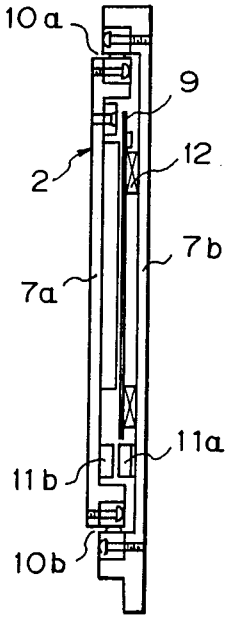
FIG. 4 is a cross sectional view of the linear direct current motor illustrated in FIG. 3.
Figure 3:
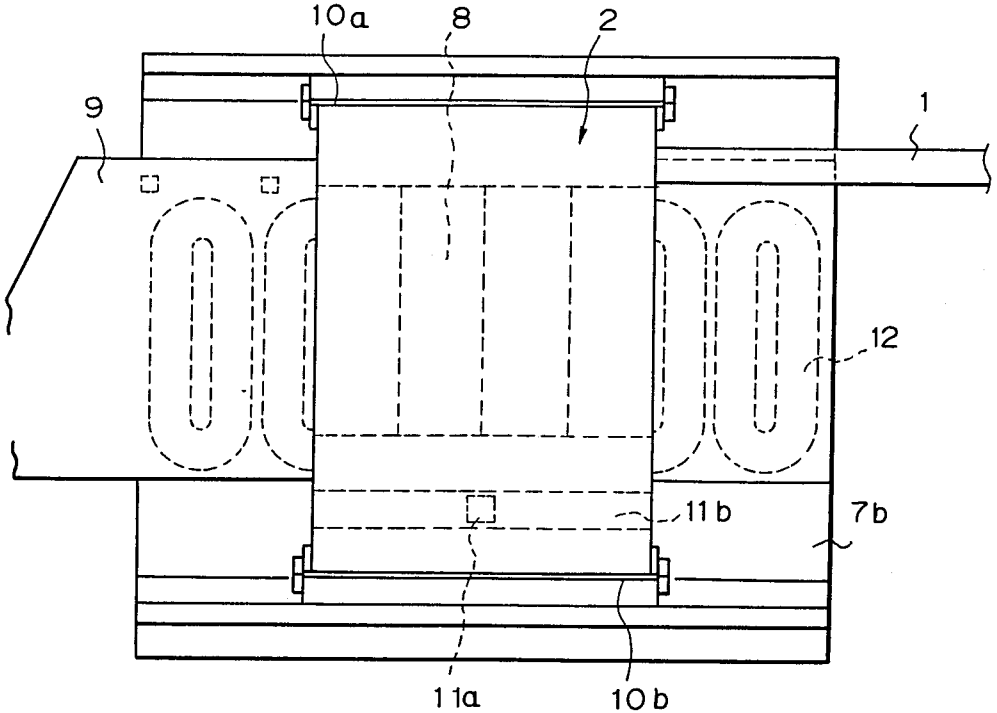
FIG. 3 is a front view illustrating an embodiment of an extra thin moving magnet type linear direct current motor used as an actuator of the flat knitting machine in accordance with the present invention.

FIGS. 3 and 4 show an embodiment in which linear direct current motors are used as the actuators 17 of the knitting machine of the present invention. FIG. 3 is a front view of the linear direct current motor, and FIG. 4 is a cross sectional view thereof. As shown in FIG. 3, a knitting needle 1 is connected to a movable element 2 of the linear direct current motor. The movable element 2 is slidably arranged in bearings 10*a* and 10*b* on a stator 7*b*. As shown in FIG. 3, coils 12 are arranged on the stator 7*b* and four permanent magnets 8 are arranged on the movable element 2 opposing the coils 12. The thrust force applied to the movable element 2 can be controlling by switching a leading direction of the electric current according to the polarities of the permanent magnets 8. Since the movable element 2 is constituted with an iron core 7*a* and the permanent magnets 8, in the linear direct current motor, a lead wire for the movable element, which is necessary in a linear pulse motor, becomes unnecessary.

The operational principle of the moving magnet three phase linear direct current motor shown in FIGS. 3 and 4 is well known by persons with ordinary skill in the art and is described in detail in an "Analysis of Moving Magnet Type Linear DC Motors Driven by Three Phase Current for a Long Stroke" by Y. Kano et al. of Tokyo University of Agriculture and Technology, published as a report on the study of Magnets in the Institute of Electrical Engineers of Japan, Vol MAG-85, No. 111-119 Page 77-86. Therefore, a detailed description of this operation will not be given in this specification.

A positioning sensor of the movable element 2 is constituted by a thin rubber magnet 11*b* adhered to the movable element 2, as shown in FIG. 3, and magnetized at a fine pitch, and a magnetic resistance element 11*a* adhered to a position corresponding to the position of the rubber magnet 11*b*, on the stator 7*b* as shown in FIG. 4. Therefore, pulse signals denoting a moving distance of the movable element 2 are emitted from the magnetic resistance element 11, and thus a control of the positioning of the movable element 2 can be achieved. Since the above-mentioned controlling technique is also well-known and is described in detail in the above-mentioned report by Y. Kano, a detailed description of this technique will not be given in this specification.

Figure 5:
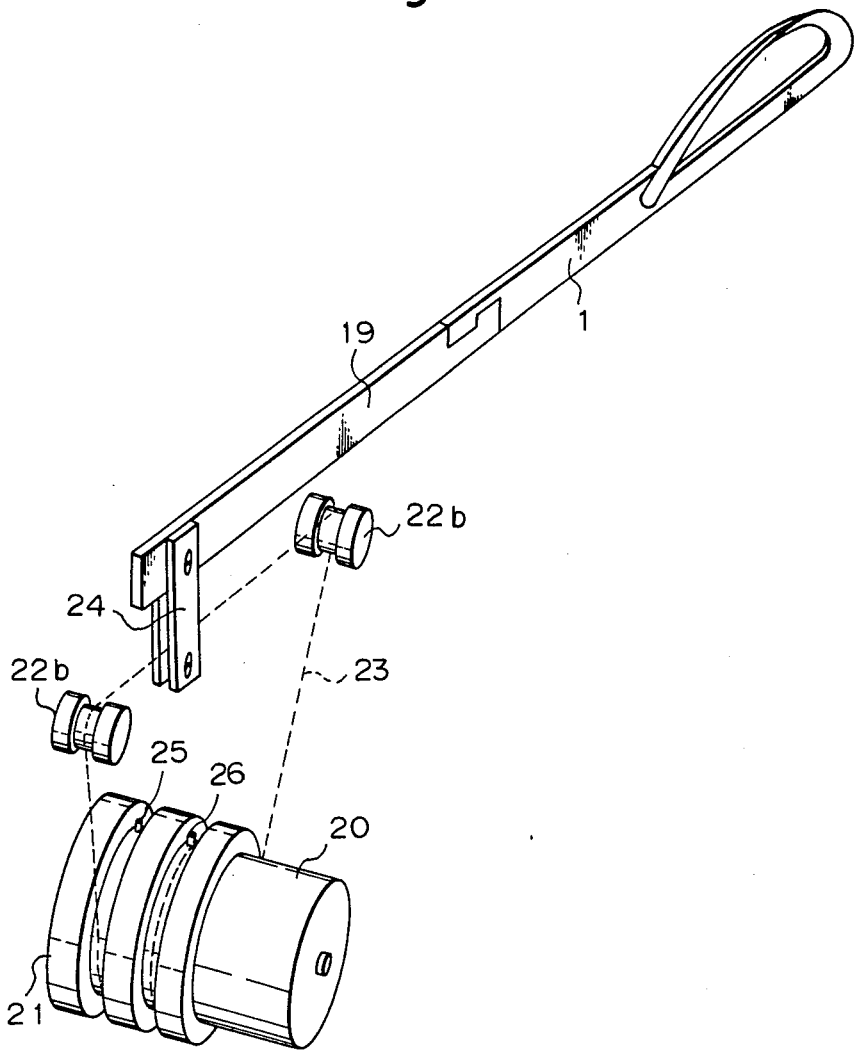
FIG. 5 is a perspective view illustrating an embodiment of a rotary motor type actuator used as another actuator of the flat knitting machine in accordance with the present invention.
Figure 6:
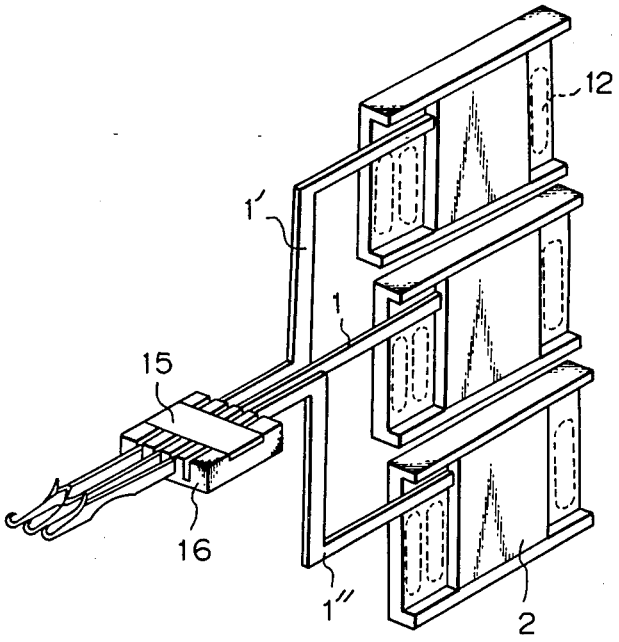
FIG. 6 is a perspective view illustrating an embodiment of a multistage type actuator.

In this embodiment of the present invention, the linear direct current motor is used as the actuator, but various rotary motors can be also used as the actuator, and the case wherein the rotary motor is used is shown in FIG. 5. As shown in FIG. 5, a pulley 21 having two grooves is attached to one end of a rotational shaft of a rotary motor 20, and two pins 25, 26 are attached at the same rotational angle in each groove, as shown in FIG. 5. One end of a wire 23 is attached to the pin 25 in a state wherein the wire 23 is wound in a normal revolutional direction in the groove, and the other end of the wire 23 is attached to a pin 26 in a state wherein the wire 23 is wound in a reverse revolutional direction in the groove. The wire 23 is formed in loop through pullies 22*a*, 22*b* capable of freely rotating, and a jack 19 is connected through a connecting member 24 to the wire 23. As the jack 19 is connected to the knitting needle 1, it is possible to cause a sliding movement of the knitting needle 1 to obtain a knitting movement thereof by a normal rotation or a reverse rotation of the rotary motor 20.

If a replacement of a damaged knitting needle is to be made, if the jack 19 is arranged between the actuator 17 and the knitting needle 1 as shown in FIG. 5, the knitting needle can be replaced without removing the actuator 17, and thus is extremely convenient for maintenance of the machine. Preferably, the jack 19 is also arranged between the knitting needle 1 and the actuator 17 in the linear motor of the first embodiment.

Generally, a plurality of knitting needles 1 are arranged in parallel and with a high density in the knitting machine. The density of the arrangement of the knitting needles 1, i.e., a gauge depends on the design of the flat knitted fabric to be knitted. The distance between the axes of adjacent knitting needles 1 is approximately from 2 mm to 9 mm. Note, when an actuator 17 is to be connected to each knitting needle 1, sometimes the width of the actuator 17 is larger than a distance between the axes of the adjacent knitting needles 1. In this case, the actuator 17 may be arranged in a multistage manner and the movable element of the actuator also arranged in a multistage manner, and the knitting needles 1 arranged in one plane may be connected by a straight arm or a folded arm. For example, when the width of the actuator is 6 mm and the distance between the adjacent knitting needles is 2 mm, the actuators 17 are arranged in three stages, and the movable element of the actuator 17 arranged at a center position thereof is connected to the corresponding knitting needle 1 by the straight arm. Note, the movable elements of the actuators 17 arranged as an upper stage and a lower stage may be connected to the corresponding knitting needle 1 by a folded arm having an L-shape.

A driving system of the running device for reciprocally moving the thread feeding unit in either direction along the knitting needle guiding member and the supporting rail supporting the running device will be now explained. As is well known, the cams to be used for knitting and the thread feeding unit are simultaneously reciprocally moved along the needle bed by the carriage in the conventional flat knitting machine, and the carriage is driven by a combination of a rotary motor and chain. In the flat knitting machine of the present invention, it is possible to drive the running device by a rotary motor and a chain or a belt. However, when a plurality of running device are moved independently, respectively, a plurality of driving systems are necessary and the system thus becomes extremely complicated. Therefore, as described in claims 14 and 15, if a linear motor mechanism wherein the stator is the supporting rail and the movable element is the running device is used, and the running device moves reciprocally on the supporting rail, it is possible to provide a simple driving system in which several running devices can be independently moved. Further, if a moving magnet type linear direct current motor is used as the linear motor, the movable element may be fundamentally constituted by an iron core and a permanent magnet, and thus a lead wire connecting the movable element to an electric source is unnecessary, and the construction of the driving mechanism is simplified.

Figure 7:
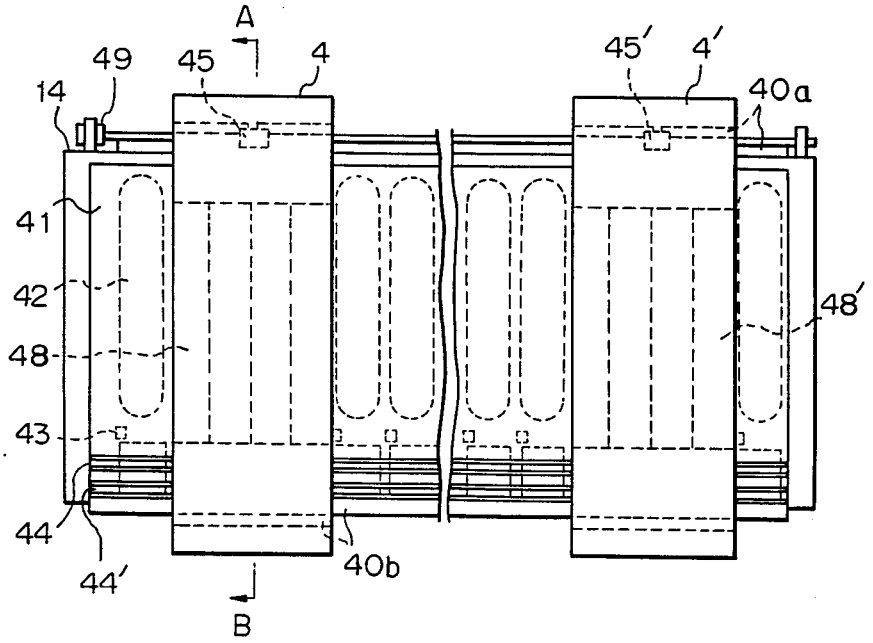
FIG. 7 is a front view illustrating an embodiment of a moving magnet type linear direct current motor for driving a running device used in the flat knitting machine in accordance with the present invention.
Figure 8:
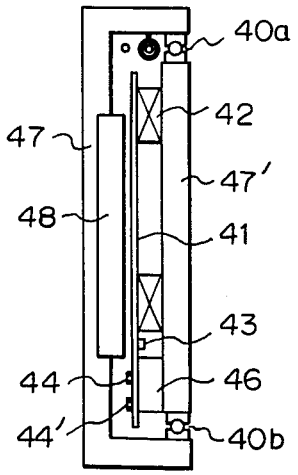
FIG. 8 is a cross sectional view taken along a line A-B of the linear direct current motor illustrated in FIG. 7.

FIGS. 7 and 8 illustrate an embodiment in which the moving magnet type linear direct current motor mechanism wherein the stator is the movable element and the core is the supporting rail. FIG. 7 is a front view and FIG. 8 is a cross sectional view taken along the line A-B. FIG. 7 shows a moving magnet linear direct current motor wherein two movable elements, i.e., the running device 4 and the running device 4', move on one stator, i.e., the supporting rail I4. The movable elements are constituted by magnets 48 and 48' and iron cores 47 and 47' and are slidably supported on the stator 14 by bearings 40*a* and 40*b*. The movable element magnets 48 and 48' comprise four pole, and coils 42 are aligned in one row along the direction of the reciprocal movement of the movable elements 48 and 48' on the stator 14, thus constituting a three phase linear direct current motor.

The operational principle of the moving magnet linear direct current motor is well known and described in detail in above-mentioned report by Y. Kano. Therefore a detailed description of this technique will not be given in this specification.

In the embodiment using this type of driving mechanism, positioning sensors 45 and 45' and a position controller (not shown in the drawing) becomes necessary for each movable elements 48 and 48', to ensure that the plurality of movable elements 48 and 48' move freely on the stator 14. In the drawing, a system in which positions of the movable elements 48 and 48', i.e., the running device, are sensed by detection of the measuring elements 45 and 45' attached to the movable elements 48 and 48' respectively, by the magnet ostriction type positioning sensor. However, an alternative system, e.g., a positioning sensor wherein a wire fixed to the movable element rotates a rotary encoder, can be used.

When increasing the knitting speed by increasing the number of the thread feeding units, a number of cams corresponding to the numbers of thread feeding units must be provided. However, the increase in the knitting speed can be achieved by providing a plurality of the thread feeding units to the running device, providing a plurality of the running devices to the supporting rail, and providing a plurality of the supporting rails, or a combination of the above-mentioned means, in the flat knitting machine of the present invention.

Figure 9:
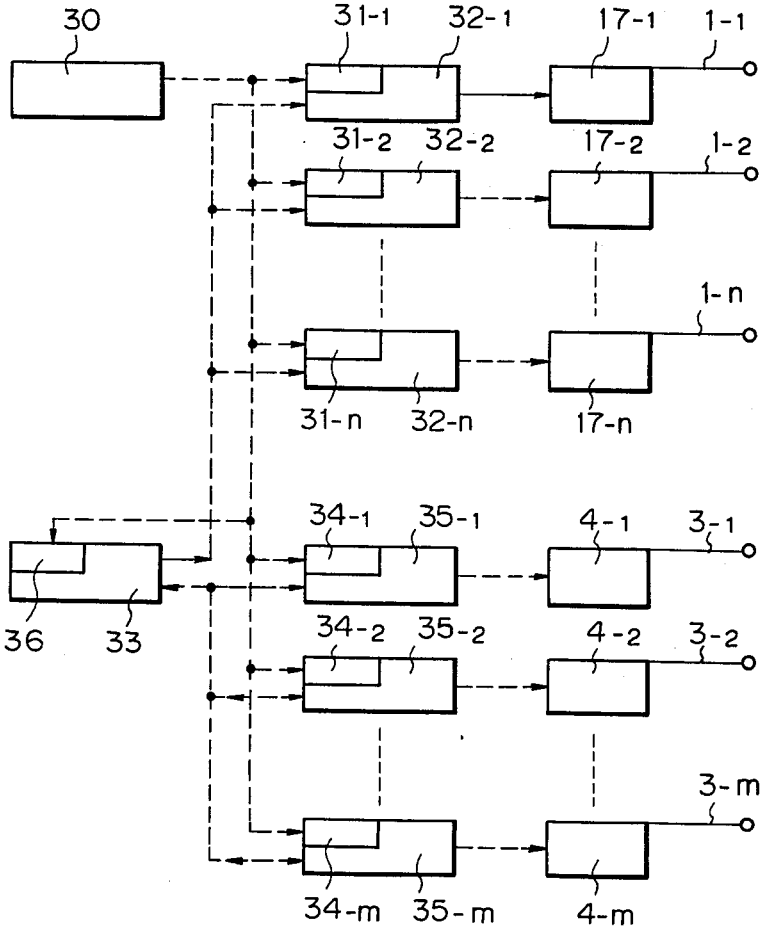
FIG. 9 is a functional block view illustrating an embodiment of a controlling apparatus used in the flat knitting machine in accordance with the present invention.

A controlling apparatus for controlling the operation of the actuator slidably moving the knitting needle in synchronism with the reciprocal movement of the thread feeding unit, and a method for knitting by using this controlling apparatus will be described with reference to FIG. 9 showing a functional block view of an embodiment of the controlling apparatus relating to the flat knitting machine of the present invention. As shown in FIG. 9, each of a plurality of knitting needles $\mathbf{1}_{-1}$ to $\mathbf{1}_{-n}$ is connected with one of a plurality of actuators $\mathbf{17}_{-1}$ to $\mathbf{17}_{-n}$ slidably and individually moving the knitting needles $\mathbf{1}_{-1}$ to $\mathbf{1}_{-n}$. The actuators $\mathbf{17}_{-1}$ to $\mathbf{17}_{-n}$ are correspondingly connected with first controllers $\mathbf{32}_{-1}$ to $\mathbf{32}_{-n}$ for individually control of the sliding movement of each actuator $\mathbf{17}_{-1}$ to $\mathbf{17}_{-n}$. The first controllers $\mathbf{32}_{-1}$ to $\mathbf{32}_{-n}$ are provided with memories $\mathbf{31}_{-1}$ to $\mathbf{31}_{-n}$ to operating the first controllers $\mathbf{32}_{-1}$ to $\mathbf{32}_{-n}$ in accordance with the predetermined knitting plan stored in the memories $\mathbf{31}_{-1}$ to $\mathbf{31}_{-n}$. Each of a plurality of the thread feeding units $\mathbf{3}_{-1}$ to $\mathbf{3}_{-m}$ is connected with one of a plurality of running devices $\mathbf{4}_{-1}$ to $\mathbf{4}_{-m}$, and the running devices $\mathbf{4}_{-1}$ to $\mathbf{4}_{-n}$ are correspondingly connected with second controllers $\mathbf{35}_{-1}$ to $\mathbf{35}_{-m}$ controlling the reciprocal movement of the running devices $\mathbf{4}_{-1}$ to $\mathbf{4}_{-m}$. The second controllers are provided with memories $\mathbf{34}_{-1}$ to $\mathbf{34}_{-m}$ for operating the second controllers $\mathbf{35}_{-1}$ to $\mathbf{35}_{-m}$ in accordance with the predetermined knitting plan stored in the memories $\mathbf{34}_{-1}$ to $\mathbf{35}_{-m}$.

Further a third controller 33 outputting operation timing signals to the first controllers $\mathbf{32}_{-1}$ to $\mathbf{32}_{n}$ in synchronization with the operation of the second controllers $\mathbf{35}_{-1}$ to $\mathbf{35}_{m}$ is used. The third controller 33 is provided with a memory 36 for operating the third controller 33 in accordance with the predetermined knitting plan stored in the memory 36.

The data stored in the memories $\mathbf{31}_{i}$, $\mathbf{34}_{i}$, and 36 are prepared by another fundamental computer 30 programming a knitting design for the knitted fabric in accordance with the predetermined knitting plan, and this data is transmitted to the memories $\mathbf{31}_{i}$, $\mathbf{34}_{i}$ and 36, respectively, by a suitable communicating means. As the communicating means, the data can be directly transmitted by a data communication channel, or the data can be indirectly transmitted by a tape, a disk, a bubble memory or the like. Regarding the data stored in the memories; for example, data of sliding positions of the knitting needles for every knitting course, is stored in the memories $\mathbf{31}_{i}$ to $\mathbf{31}_{-n}$ of the first controllers; data of distances of the reciprocal movement of the running device with the thread feeding unit for every knitting course and datas of patterns of running speed of the running device is stored in the memories $\mathbf{35}_{-i}$ to $\mathbf{35}_{-m}$ of the second controllers, and data for selecting a running device to be driven for every knitting course and data for selecting a knitting needle to be operated in accordance with the position of the thread feeding unit are stored in the memory 36 of the third controller.

An example of the operation of the knitting needles in accordance with the functional principle of FIG. 9 is now described with reference to FIG. 10.

Figure 10:
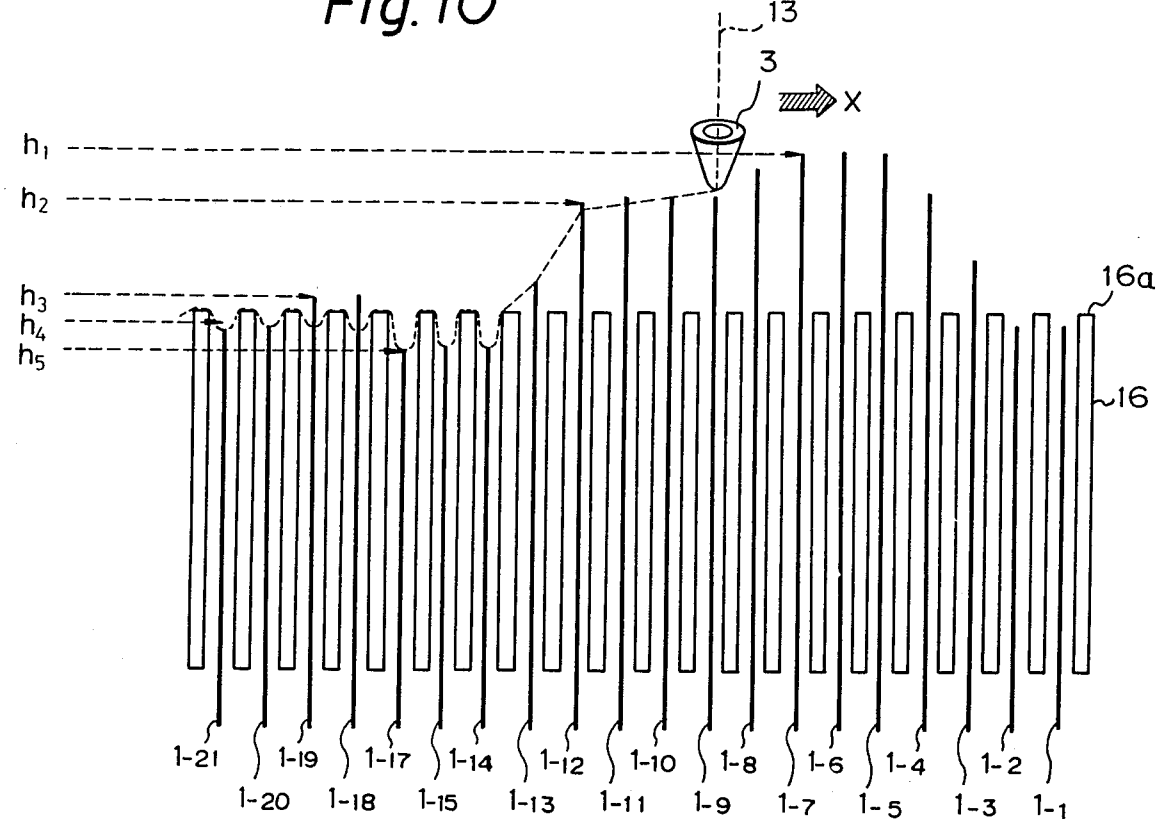
FIG. 10 is an explanatory view illustrating the operation of the knitting needle corresponding to a position of a thread feeding unit in a typical knitting example in accordance with the present invention.

When the thread feeding unit 3 moving reciprocally along the knitting needle guiding member 16 advances in the direction from left to right in FIG. 10, while feeding a thread 13, and reaches a position just above the knitting needle $\mathbf{1}_{-9}$, the third controller 33 emits the following operation timing signals for every knitting needle to each first controller.

(1) A timing signal controlling a sliding position of knitting needle $\mathbf{1}_{-2}$ such a manner that a position of an inside edge of a hook (hereinafter, referred to as "top end") the knitting needle $\mathbf{1}_{-2}$ is moved to the position $h_1$, is output from the third controller 33 to a first controller $\mathbf{32}_{-2}$.

(2) A timing signal controlling a sliding position of knitting needle $\mathbf{1}_{-7}$ in such a manner that a position of a top end of the knitting needle $\mathbf{1}_{-7}$ is moved to the position $h_2$, is output from the third controller 33 to a first controller $\mathbf{32}_{-7}$.

(3) A timing signal controlling a sliding position of knitting needle $\mathbf{1}_{-12}$ in such a manner that a position of a top end of the knitting needle $\mathbf{1}_{-12}$ is moved to the position $h_5$, is output from the third controller 33 to a first controller $\mathbf{32}_{-12}$.

(4) A timing signal controlling a sliding position of knitting needle $\mathbf{1}_{-17}$ in such a manner that a position of a top end of the knitting needle $\mathbf{1}_{-17}$ is moved to the position $h_3$, is output from the third controller 33 to a first controller $\mathbf{32}_{-17}$.

(5) A timing signal controlling a sliding position of knitting needle $\mathbf{1}_{-19}$ in such a manner that a position of a top end of the knitting needle $\mathbf{1}_{-19}$ is moved to the position $h_4$, is output from the third controller 33 to a first controller $\mathbf{32}_{-19}$.

Similarly, the positions of each knitting needle in the sliding direction are sequentially controlled in such a manner that the positions of the top end of the each knitting needle are moved to the positions $h_1$, $h_2$, $h_5$, $h_3$, and $h_4$ when the thread feeding unit approaches that knitting needle. A concrete data, e.g., moving length of the corresponding knitting needle or the like regarding the position $h_1$, $h_2$, $h_5$, $h_3$ and $h_4$, is previously stored in each memory 31 of each first controller 32 for every knitting course. The positions of the top ends of the knitting needle in a standard knitting design are illustrated in FIG. 10. However, it is possible to form different stitches such as a tuch stitch or the like by changing the value corresponding to the positions $h_1$, $h_2$, $h_5$, $h_3$ and $h_4$, to knit various knitted fabrics having different knitting designs. A distance between the top end of the knitting needle in a retracted position and an outermost end 16*a* of the knitting needle guiding member 16 is defined by the position $h_5$ as shown in FIG. 10, and the size of the loops in the knitted fabric is determined by the position $h_5$. The data for the position $h_5$ are previously stored in the each first controller in accordance with the predetermined knitting plan for every course. Therefore if the data for the position $h_5$ are suitably programmed when the designed data is stored in the fundamental computer, i.e., the computer 30 in FIG. 9 for designing the knitting design of the knitting fabric, it is possible to knit a knitting fabric having the appearance and feeling of a hand knitted fabric, or a knitted fabric having a pattern.

The dimensions of the embodiment of the flat knitting machine and knitting examples are now described with reference to FIGS. 1 to 10.

The knitting mechanism in accordance with the present invention is applied to a flat knitting machine having a knitting width of 21 inches, a needle gauge, i.e., number of knitting needles per inch, of 9, a total number of knitting needles of 189, and a distance between adjacent knitting needles of about 2.82 mm. A moving magnet type linear direct current motor as described in FIGS. 3 and 4 is connected to each knitting needle as an actuator. The thickness of the outside frame of a movable element in this actuator is 3 mm, and the magnets used are made of an element from a neodymium cobalt group of rare earth elements (supplied by Sumitomo Tokushu Kinzoku K.K.). The thickness of the magnet is 2.4 mm, the thickness of the coil is 1.8 mm, and the gap between the magnet and the coil is 0.8 mm, giving a total thickness of 8 mm. Therefore, in this example the three motors are arranged in three stages, and each motor is superimposed on the other in a state wherein a position of each motor coincides a position of the corresponding knitting needle to form a 9 gauge knitting mechanism. In this linear direct current motor, four magnets having a 12 mm width, 40 mm height, and 1.2 mm thickness are used, and arranged in such a manner that the magnetic poles opposing the coil 12 are alternately N or S. The magnetic flux density in the coils is about 4,000 gauss.

The coils 12 are arranged at a pitch of 12 mm and, coreless type coils having a total width of the coil of 14 mm, a winding width at one side of 5 mm, and a center opening having a width of 4 mm, are prepared. A 0.26 mmϕ magnet wire is wound for 110 turns on a coiling space 6 mm×1.8 mm, and an effective length of one turn is about 28 mm.

The thrust force of this motor is calculated as follows $$F=4BIL$$

where

F: Thrust force of linear motor [N]

B: Magnetic flux density in coil portion [T]

I: Current in Coil [A]

L: Total effective length of coil [m]

The thrust force of the linear motor used in this example is calculated as follows, when the current in the coil is 3 A.

$$\begin{aligned} F &= 4 \times 0.4 \times 3 \times 0.028 \times 110 \\ &= 14.8\ [N] \end{aligned}$$

This thrust force is confirmed by measuring the value with a spring balance.

Since the total weight of the movable element of this linear direct current motor is about 100 g, the force required for a knitting operation is about 170 gf and a sliding resistance of the knitting needle is about 30 gf, thus a maximum acceleration α in this case is calculated as follows $$\begin{aligned} \alpha &= (14.8 - 0.17 \times 9.8 - 0.03 \times 9.8) \div 0.1 \\ &= 128.4\ \mathrm{m/sec^2}. \end{aligned}$$

Namely, a high acceleration of about 13.1 G is obtained.

The movable element of this linear motor has a total width of 48 mm, and four magnets having a width of 12 mm are arranged thereon. The stator has a total width of 60 mm, and six coils having a pitch of 16 mm are arranged thereon. Therefore, the movable element can slide within a stroke of 48 mm. Then if one magnetic resistance element is attached to a center of the stator and a thin rubber magnet is adhered over the width of the movable element, it is possible to control the positions of the movable element within a range of 48 mm. Since a stroke required for the knitting operation of the knitting needle is 40 mm, the above-mentioned value of 48 mm satisfies the condition requirements for the sliding motion of the knitting needle.

In the knitting pattern illustrated in FIG. 10, when the position $h_4$ is defined as the 0 (zero) point, then +25 mm is adopted as the position $h_1$, +13 mm as position $h_2$, −3 mm as position $h_5$, and +2 mm as position $h_3$. The top end of the knitting needle is moved during one cycle of about 0.1 sec.

A moving magnet linear direct current motor can be also used for a driving mechanism of the running device. In this case, the supporting rail is used as the stator and the running device is used as the movable element. In this example, two supporting rails and a running device on each supporting rail are used as shown in FIGS. 1 and 2 to form the moving magnet type linear direct current motor mechanism of two thread feeding system. The construction of this motor is the same as that of the motor shown in FIG. 7. The thickness of the iron cores 47 and 47' is 2 mm, the thickness of the magnet 48 is 5 mm, the thickness of the coil 42 is 4.5 mm, and a gap between the coil and the magnet is 0.5 mm. The coil 12 prepared by winding a 0.26 mmϕ magnet wire for 181 turn is arranged at a pitch of 16 mm in a state opposing the magnet 48. An effective length of the coil 12 is 50 mm. The thrust force of this linear motor mechanism applied by supplying an electric current of 2 A, and when measured by a spring balance is between 3.2 to 3.6 kgf. When the total weight of the moving member including the thread feeding unit and the running device is about 200 g, this moving member can attain a speed of 2 m/sec after an auxiliary running of about 100 mm.

Regarding the controlling apparatus, in the control system shown in FIG. 2, an 8 bit microcomputer (Z-80 supplied from ZIOLG Co.) is used for the first controllers $\mathbf{32}_{-1}$ to $\mathbf{32}_{-189}$ and the second controllers $\mathbf{35}_{-1}$ to $\mathbf{35}_{-2}$, a 16 bit microcomputer (i-8086 supplied from INTEL Co.) is used for the third controller 33, and a 16 bit personal computer (PC-9801 supplied from Nihon Denki Co.) is used as the fundamental computer 30.

When a flat knitted fabric having plain stitch design, and a width of 21 inches, is knitted by the knitting needles shown in FIG. 9, by using two threads of an acrylic bulky spun yarn 2/34 Nm fed by the thread feeding unit of the running device advancing at a speed of 2 m/sec and the flat knitting machine claimed in claim 3 and described in detail hereinbefore, the flat knitted fabric can be obtained at a speed of about 400 courses/min.

Since a productivity of a conventional flat knitting machine having a 9 gauge is at maximum 80 courses/-min, the productivity of the flat knitting machine of the present invention is five times that of the conventional flat knitting machine, and if the number of thread feeding units is increased, as described hereinafter, a corresponding increase in the productivity can be obtained.

The novel flat knitted fabric capable of being knitted by the flat knitting machine of the present invention will now be described with reference to FIGS. 10 to 16.

First, a knitted fabric comprised of a plurality of knitting loops having an irregular loop length will be described with reference to FIGS. 10 to 14.

Figure 11:
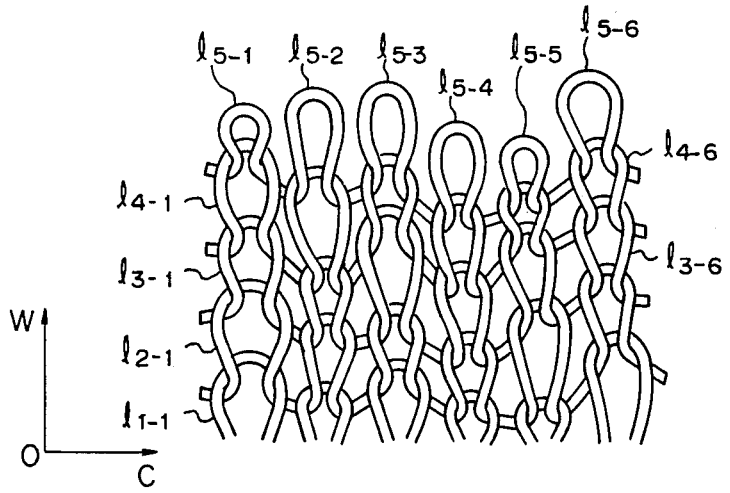
FIG. 11 is a view of model loops of an embodiment of the flat knitted fabric in accordance with the present invention.
Figure 12:
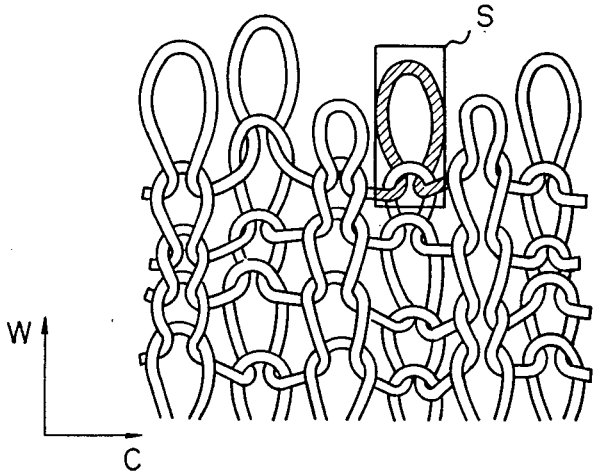
FIG. 12 is a view of model loops of another embodiment of the flat knitted fabric in accordance with the present invention.

A model loop view of an embodiment of the flat knitted fabric of the present invention is shown in FIG. 11 and a model loop view of another embodiment is shown in FIG. 12.

$l_{1-1}$ to $l_{5-6}$ in FIG. 11 denote individual loops, respectively. The term "length of loop" in this specification expresses the length required to form one loop $l_{i-j}$ and is a summation of a needle loop and a sinker loop as indicated by oblique lines in the enclosed space S in FIG. 12. The term "irregular" in this specification may include a case wherein the length of the loop changes continuously, as in the prior art, but preferably, the size of each adjacent individual loop is discontinuously changed.

The irregular loops similar to loops in a hand knitted fabric can be formed by discontinuously changing the size of each adjacent individual loop. Note, if the size of loop is merely changed at random, the dimension of knitted fabric formed as an aggregate of irregular loops is greatly changed for every course or every wale, and it is impossible to obtain a knitted fabric having the dimensions determined in the predetermined knitting design. Especially in a fully fashioned knitted fabric, a length of the knitting fabric is changed at every course and/or every wale, and when a sweater is made by sewing together this knitted fabric, a course or a wale having a short length will draw up one portion of the knitted fabric, so that the shape of the sweater is degraded. To solve this problem and obtain a good shape, preferably the knitting is carried out in such a manner that the number of knitting rows in which a summation of the length of the loops constituting a portion having a maximum length in a course direction or a wale direction of a specific knitted fabric is the same is at least 10% of the total number of the knitted rows of the course or the wale constituting the specific knitted fabric.

Figure 13A:
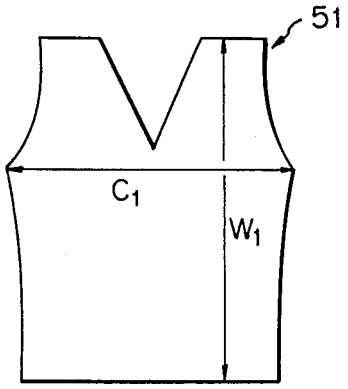
FIGS. 13(*a*) through 13(*c*) are plan views of a unit knitted fabric illustrating a maximum distance portion in the knitted fabric respectively.
Figure 13B:
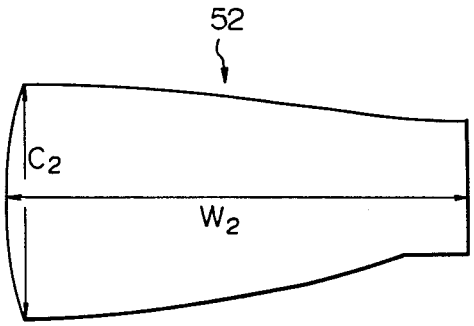
Figure 13C:
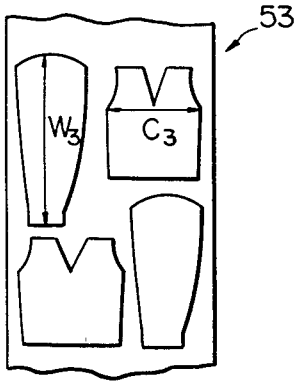

The term "a portion having a maximum length in a course direction or wale direction of a specific knitted fabric" is now explained with reference to FIGS. 13(*a*) to 13(*c*). The portion having the maximum length is a portion having a largest dimension in the course direction or the wale direction of a piece of knitted fabric forming one segment of the knitted fabric. For example, in a front body of a vest shown in FIG. 13(*a*), the portion having the maximum length in the course direction is $C_1$, and the maximum length in the wale is $W_1$, and in a sleeve shown in FIG. 13(*b*), the portion having the maximum length in the course direction is $C_2$ and the maximum length in the wale is $W_2$. Where the knitted fabric has a constant width and long length, such as a jersey, the portion having the maximum length is defined for the unit of knitted fabric to be cut as one piece from the fabric when making apparel For example, in FIG. 13(*c*), the portion having the maximum length in the course direction is $C_3$ and the maximum length in the wale is $W_3$. Note, when a shape of the unit of knitted fabric corresponds to a shape of a portion constituting the apparel and is not usually a rectangle, often only one portion has the maximum length in the course direction or the wale direction. In this case, the meaning of "the summation of the length of the loops constituting the portion having the maximum length in the course direction or in the wale direction of the specific knitted fabric is the same" may be interpreted such that a value obtained by converting the value of the above-mentioned summation in a specific course or wale to a value of summation in another corresponding course or wale on the basis of the number of loops constituting the specific knitted fabric and another corresponding knitted fabric is the same.

Even if the flat knitted fabric is knitted under a condition in which a thread tension is carefully kept constant during the knitting, there is usually an error of 0% to 4% in the length of the loop. Accordingly, the term "the summation of the length of the loops is the same" is interpreted such that a difference of the value of the summation is within 4% of the value of the summation.

When the number of knitting rows in which the summation of the length of the loops constituting a portion having a maximum length measured or calculated under the above-mentioned conditions is the same, is at least 10% of total number of the knitting rows constituting the specific knitting fabric, an excellent shape of the flat knitted fabric can be maintained. In FIG. 11, a value of summation of the length of the loops in a course between a loop $l_{2\text{-}1}$ and a loop $l_{2\text{-}6}$ and a value of summation in a course between a loop $l_{3\text{-}1}$ and a loop $l_{3\text{-}6}$, and a value of summation in a course between a loop $l$4-1 and a loop $l$4-6 is different from two above-mentioned values. Preferably, the number of knitting rows in which the summation of the length of the loops in the course direction or in the wale direction in the same is 30% or more of the total number of the knitting rows of the course or the wale, to maintain the shape of the knitted fabric.

Regarding the term "an irregular length of the loop", in a loop having a different length, the difference in the length of the loop is 4% or more. However since the difference in the length of the loop does not clearly appear when the above-mentioned difference is 5% to 6%, preferably the difference in the length of the loop is 10% or more when knitting a knitted fabric having such irregular loops.

A portion having the irregular loops may be partially or wholly arranged in the knitted fabric. Further, the irregular loops may be formed in a knitted fabric having a jacquard pattern by applying this technique to a thread constituting the jacquard pattern.

Figure 14:
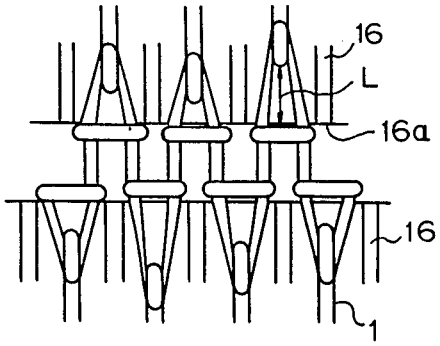
FIG. 14 is an enlarged model view of a knitted portion of the knitted fabric.

The manufacture of this knitted fabric having irregular loops can be achieved by the flat knitting machine of the present invention, by suitably changing the retracting length of each knitting needle. The retracting length is defined as a distance L as shown in FIG. 14.

An example of the knitted fabric having the irregular loop will now be described. In this fabric, two threads of acrylic spun yarn 2/26 Nm are used. The first course in this knitting process is knitted by applying data making each retracting length of the knitting needles different, to each knitting needle, and the second course is knitted by applying data making each retracting length of the knitting needles different. This second data is different from the data for the first course. This knitting procedure is repeated for 120 courses. In this process, the knitted fabric is knitted in such a manner that the summation of the retracting length of each knitting needle in the fifth course is the same as that in the first course, and this knitting procedure is repeated. Further regarding the retracting length of two knitting needles at the ends and the retracting length of a knitting needle in the center, the knitting process is controlled in such a manner that the values of the summations of those retracting lengths become the same during the 120 courses. When a plain stitch fabric and a rib stitch fabric are knitted under the conditions described hereinbefore, and the retracting length of the knitting needle is changed from 1.5 mm to 8.0 mm, both knitted fabrics have suitably irregular loops, as in a hand knitted fabric and the shapes of the knitted fabrics are excellent.

A knitted fabric having a pattern capable of being knitted by the flat knitting machine of the present invention will now be described with reference to FIGS. 15 and 16.

Figure 15:
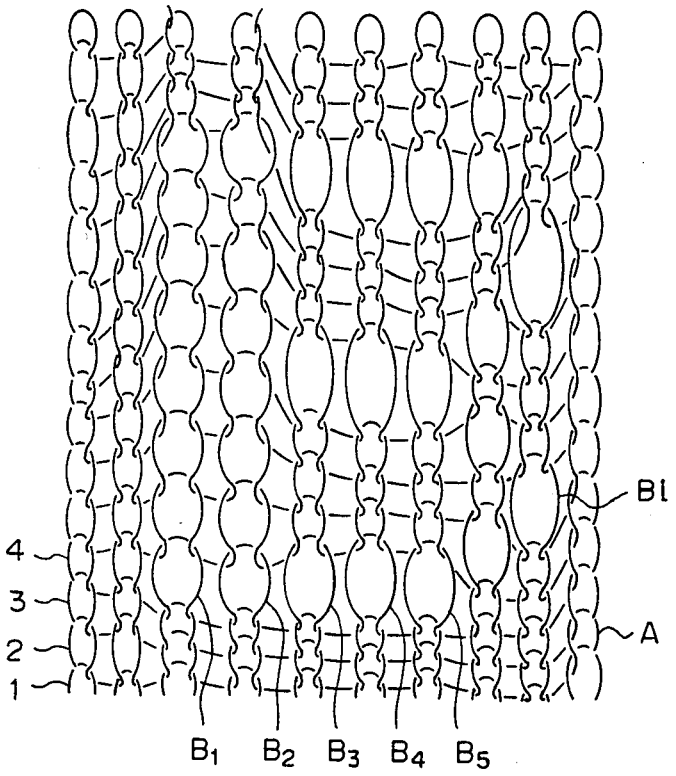
FIG. 15 is a model loop view illustrating an embodiment of the knitted fabric having a pattern; and, FIG. 16 is a model loop view illustrating another embodiment of the knitted fabric having a pattern.

A model loop view of an embodiment of this type of knitted fabric is shown in FIG. 15. The knitted fabric shown in FIG. 15 comprises a group of relatively small loops, indicated as A, and a group of relatively large loops, indicated as $B_i$. Note, in this fabric the letter "B" is formed by the group of relatively large loops. In FIG. 15, (1) indicates a first course. This first course (1) is formed by aggregating the loops A, and the second course (2) and third course (3) are also formed by aggregation of the loops A. However, in the fourth course (4), the loops A and the relatively large loops $B_1$ to $B_5$ are arranged in a mixed state. Then several courses in which the loops A and the loops $B_i$ are mixed are knitted, as shown in FIG. 15, and thus the letter "B" is formed in the flat knitted fabric.

Figure 16:
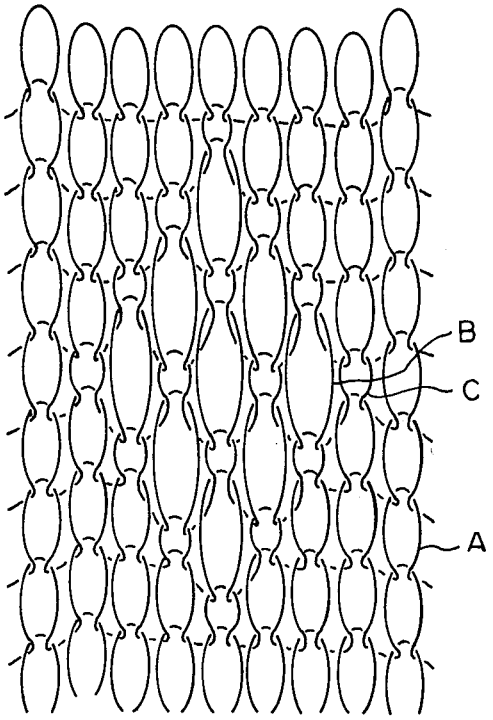

A model loop view of another embodiment of this type of knitted fabric is shown in FIG. 16. The knitted fabric shown in FIG. 16 is comprised of a group of middle size loops, indicated as A, a group of relatively large loops, indicated as B, and a group of relatively small loops, indicated as C. A diamond pattern is formed in the knitted fabric by the group of relatively large loops B, and the group of relatively small loops C is arranged between each of the loops B forming the outline of the diamond pattern, so that this outline of the diamond pattern become clearer.

In this case, the term "a loop having a different length" also denotes loops in which the length of the loop is different by 4% or more. However, since the loops having the length of loops difference of 5% to 6% cannot form the pattern alone, preferably the difference of 10% or more is applied to the length of the loops. To form an ombre pattern, preferably a difference of 10% to 100% is applied to the length of the loops, more preferably, a difference of 100% to 500% is applied to obtain a clear pattern. If a difference of 500% or more is adopted in the length of the loop, problems will occur in the knitting process.

As the loops for forming the pattern, one kind of loop, i.e., loop B as shown in FIG. 15, or two kinds of loop, i.e., loop B and loop C, as shown in FIG. 16 may be used. Further, if three or more loops can be used to form a pattern when various types of loops having different lengths of the loops are used, the pattern becomes complicated and it is possible to provide a knitted fabric having a high quality pattern.

As the pattern capable of being knitted by using loops having different lengths, various pattern can be applied. For example, a flower pattern, a letter pattern, a birds eyes pattern formed by arranging the loops A and loops B shown in FIG. 15 alternately, or the like can be applied. Consequently, a pattern in which the loops have different lengths and are arranged in a substantially continuous state so that the pattern appears in the aggregate, can be adopted.

The pattern of the present invention can be applied to a jacquard knitted fabric. In this case, the lengths of the loops constituting a jacquard pattern are changed, so that a pattern in which the pattern made by the jacquard knitting and the pattern made by the different lengths of the loops are overlapped, can be obtained. Further, the pattern of the present invention can be applied to a knitted fabric including different shapes of loops, e.g., a knit loop, a tuck loop, a welt loop, a front loop, a back loop, or the like.

The knitted fabric having the pattern of the present invention can be knitted by means of the flat knitting machine of the present invention and by suitably changing a retracting length of the corresponding knitting needle.

An example of a knitted fabric having the above pattern will now be described. In this fabric, two threads of acrylic spun yarn 2/24 Nm and the flat knitting machine having six knitting needles per inch of the present invention, are used. Data of a retracting length of the knitting needle in accordance with the pattern in FIG. 15 is applied to each knitting needle. Namely, as the retracting length of each knitting needle, a length of 1.0±0.3 mm is adopted for first, second and third courses. A length of 5.0+0.3 mm is adopted for five knitting needles from third needle to seventh needle viewed from the left in the fourth course, and a length of 1.0±0.3 mm is adopted for the other knitting needles in the fourth course. A length of 5.0±0.3 mm is adopted for three knitting needles of the second and third needles viewed from the left and the third needle viewed from the right in the fifth course, and a length of 1.0±0.3 mm is adopted for the other knitting needles in the fifth course. This knitting procedure is repeated for 120 courses in accordance with the pattern shown in FIG. 15.

The obtained knitted fabric have a plurality of holes formed by the group of relatively large loops, and the letter "B" is formed by these continuous large loops.

I claim:

1. A method for knitting a flat knitted fabric by using a flat knitting machine comprised of a plurality of knitting needles each having an actuator and arranged, in parallel in a plane; a knitting needle guiding member slidably supporting said plurality of knitting needles, extended in either direction along said plane and defining each distance between adjacent knitting needles; and a running device having at least one thread feeding unit and reciprocally moving in either direction along said knitting needle guiding member, wherein a position of the thread feeding unit of the running device is detected and a signal in accordance with a predetermined knitting plan is input to the actuator of each knitting needle corresponding to the position detected of the thread feeding unit, whereby a sliding movement in accordance with said predetermined knitting plan is applied to said knitting needle to knit said flat knitted fabric.

2. A method for knitting a flat knitted fabric according to claim 1, wherein said predetermined knitting plan includes sliding lengths of the sliding movement of the knitting needle and orders of operation thereof, different sliding length being stored for at least some knitting needle, whereby each knitting needle performs the knitting movement at a different retracting length.

3. A flat knitting machine including at least one knitting mechanism comprised of a plurality of knitting needles arranged in parallel in a plane and a knitting needle guiding member slidably supporting said plurality of knitting needles, extended in either direction along said plane and defining each distance between adjacent knitting needles to form a knitting loop; at least one running device capable of reciprocally moving in either direction along said knitting needle guiding member, at least one thread feeding unit being provided in said running device; an actuator for slidably moving a corresponding knitting needle and connected to each knitting needle of said plurality of knitting needles; and a controlling apparatus having a memory storing a predetermined knitting plan and controlling operation of said actuator in synchronism with the reciprocal movement of said thread feeding unit in accordance with the predetermined knitting plan.

4. A flat knitting machine according to claim 3, wherein said controlling apparatus is comprised of first controllers for performing positioning control of the corresponding knitting needle in accordance with the predetermined knitting plan stored in the memory, at least one second controller for controlling the reciprocal movement of the thread feeding unit in accordance with the predetermined knitting plan, and a third controller for controlling an operation timing corresponding to an operation of the second controller in the first controller in accordance with the predetermined knitting plan.

5. A flat knitting machine according to claim 3, wherein said controlling apparatus is comprised of first controllers having a memory storing sliding positions of a corresponding knitting needle, connected to a corresponding actuator and performing positioning control of the corresponding knitting needle in accordance with the predetermined knitting plan, at least one second controller having a memory storing running plans of a corresponding running device, arranged for every thread feeding unit and for performing control of the running of the thread feeding unit in accordance with the predetermining knitting plan, and a third controller having a memory storing an operation timing plan corresponding to operation of the second controller in the first controller and outputting operation timing signals corresponding to operation of the second controller to the first controller in accordance with the predetermined knitting plan.

6. A flat knitting machine according to claim 3, wherein a thin and compact type linear motor having a movable element connected to said knitting needle is used as the actuator, thereby sliding positions of each knitting needle are individually controlled.

7. A flat knitting machine according to claim 3, wherein a thin and compact type linear motor having a movable element connected to said knitting needle is used as the actuator, and a magnetic bearing is used as a bearing supporting the movable element, whereby the sliding positions of each knitting needle are individually controlled.

8. A flat knitting machine according to claim 3, wherein a thin and compact type linear direct current motor having a movable element connected to said knitting needle is used as the actuator, whereby sliding positions of each knitting needle are individually controlled.

9. A flat knitting machine according to claim 3, wherein a thin and compact type rotary motor and a device converting rotational movement of said motor to linear movement is used as the actuator, whereby sliding positions of each knitting needle are individually controlled.

10. A flat knitting machine according to claim 3, wherein said knitting needle is disconnectably connected to the movable element of the actuator.

11. A flat knitting machine according to claim 3, wherein a plurality of actuators are arranged in multistage construction, and the plurality of knitting needle arranged in the plane and the movable elements of the actuators are connected with said arms, respectively.

12. A flat knitting machine according to claim 3, wherein a rail supporting said running device is arranged along said knitting needle guiding member and two or more of said running devices are slidably arranged on the rail.

13. A flat knitting machine according to claim 3, wherein two or more rails supporting said running device are arranged along said knitting needle guiding member and at least one running device is slidably arranged on the rail.

14. A flat knitting machine according to claim 3, wherein a rail supporting said running device is arranged along said knitting needle guiding member and a linear motor type driving mechanism in which the stator is the rail and the movable element is the running device, is formed between the rail and the running device.

15. A flat knitting machine according to claim 3, wherein a rail supporting said running device is arranged along said knitting needle guiding member and a linear direct current motor type driving mechanism in which the stator is the rail and the movable element is the running device, is formed between the rail and the running device.

* * * * *